US010343862B2

(12) United States Patent
Matsumoto et al.

(10) Patent No.: US 10,343,862 B2
(45) Date of Patent: Jul. 9, 2019

(54) SHEET CONVEYING APPARATUS AND IMAGE FORMING APPARATUS

(71) Applicant: CANON KABUSHIKI KAISHA, Tokyo (JP)

(72) Inventors: So Matsumoto, Matsudo (JP); Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/377,097

(22) Filed: Dec. 13, 2016

(65) Prior Publication Data

US 2017/0088375 A1 Mar. 30, 2017

Related U.S. Application Data

(62) Division of application No. 14/662,362, filed on Mar. 19, 2015, now Pat. No. 9,550,643.

(30) Foreign Application Priority Data

Apr. 4, 2014 (JP) ..... 2014-077456

(51) Int. Cl.

| | |
|---|---|
| ***B65H 9/16*** | (2006.01) |
| ***B65H 5/06*** | (2006.01) |
| ***B65H 7/02*** | (2006.01) |

(52) U.S. Cl.

CPC ..... *B65H 5/062* (2013.01); *B65H 7/02* (2013.01); *B65H 9/166* (2013.01); *B65H 2404/1441* (2013.01); *B65H 2511/224* (2013.01); *B65H 2515/34* (2013.01); *B65H 2701/1311* (2013.01);

(Continued)

(58) Field of Classification Search

CPC ..... B65H 9/166; B65H 9/16; B65H 5/062

See application file for complete search history.

(56) References Cited

U.S. PATENT DOCUMENTS

| | | | |
|---|---|---|---|
| 5,253,862 | A | 10/1993 | Acquaviva et al. |
| 6,273,418 | B1 | 8/2001 | Fujikura et al. |
| 6,409,043 | B1 | 6/2002 | Fujita et al. |

(Continued)

FOREIGN PATENT DOCUMENTS

| | | | |
|---|---|---|---|
| JP | 05-246584 | A | 9/1993 |
| JP | 11-189355 | A | 7/1999 |

(Continued)

*Primary Examiner* — Luis A Gonzalez

(74) *Attorney, Agent, or Firm* — Venable LLP

(57) ABSTRACT

A sheet conveying apparatus has a first pair of conveying rollers which nip and convey a sheet, a reference surface provided along the sheet conveying direction, a second and third pair of rotary members, which, obliquely with respect to the sheet conveying direction, conveys the sheet so as to contact the side edge of the sheet to the reference surface, a switching unit which switches the first pair of rotary members between a state of nipping the sheet and a state of nip releasing the sheet, a controller which, after controlling the second pair of rotary member and the third pair of rotary members to nip the sheet nipped by the first pair of rotary members, controls the switching unit to release nip of the sheet by the first pair of rotary members. There is no pair of rotary members that conveys the sheet in the sheet conveying direction between the second pair of rotary members and the third pair of rotary members in the sheet conveying direction.

6 Claims, 13 Drawing Sheets

(52) U.S. Cl.
CPC .. *B65H 2701/1313* (2013.01); *B65H 2801/06* (2013.01)

(56) References Cited

U.S. PATENT DOCUMENTS

| | | | |
|---|---|---|---|
| 6,771,928 | B2 | 8/2004 | Fujita |
| 6,896,256 | B2 | 5/2005 | Hozumi |
| 7,445,208 | B2 | 11/2008 | Onodera |
| 7,571,908 | B2 | 8/2009 | Inui et al. |
| 7,658,379 | B2 | 2/2010 | Yasumoto |
| 7,748,697 | B2 | 7/2010 | Fujita et al. |
| 8,240,665 | B2 | 8/2012 | Fujita |
| 8,308,160 | B2 | 11/2012 | Miyazawa |
| 8,342,518 | B2 | 1/2013 | Matsumoto |
| 8,699,936 | B2 | 4/2014 | Fujita |
| 8,746,693 | B2 | 6/2014 | Miyazawa |
| 2012/0091653 | A1 | 4/2012 | Miyazawa |
| 2015/0108709 | A1 | 4/2015 | Fujita et al. |

FOREIGN PATENT DOCUMENTS

| | | | | |
|---|---|---|---|---|
| JP | 2001151387 | A | * | 6/2001 |
| JP | 2004-059188 | A | | 2/2004 |
| JP | 3769913 | B2 | | 4/2006 |

* cited by examiner

SHEET CONVEYING APPARATUS AND IMAGE FORMING APPARATUS

BACKGROUND OF THE INVENTION

Field of the Invention

The present invention relates to a sheet conveying apparatus installed in an image forming apparatus such as a copying machine, a fax machine, and a printer in order to allow a sheet to be stably conveyed, and to an image forming apparatus provided with the sheet conveying apparatus.

Description of the Related Art

If a sheet in an image forming apparatus is skew-fed while being conveyed, or is misaligned in a width direction of the sheet perpendicular to the sheet conveyance direction, the apparatus ends up by forming an image misaligned with respect to the sheet. In order to deal with the problem, a sheet aligning apparatus is provided immediately in front of a transfer portion so as to correct skew feeding of a sheet and adjust the position of a sheet in its width direction. As an example of the sheet aligning apparatus, there is a sheet registration device for correcting a misalignment of a sheet being conveyed, with respect to a side edge of the sheet (see U.S. Pat. No. 6,273,418).

A sheet aligning apparatus that corrects skew feeding according to the side registration reference includes an abutting reference member along a direction in which a sheet is conveyed (sheet conveyance direction), and a pair of skew feeding correcting rollers above the sheet conveying path.

The abutting reference member has a reference surface parallel to the sheet conveyance direction. The number of pairs of skew feeding correcting rollers provided is at least two, and they are arranged along the reference surface in the sheet conveyance direction. While a sheet is being conveyed, the pairs of skew feeding correcting rollers skew-feed the sheet toward the abutting reference member and make a side edge of the sheet abut against the reference surface so that the side edge will extend along the reference surface. The skew of the sheet in the sheet conveyance direction is thus corrected. Further, since the reference surface can fix the position of a side edge of a sheet with respect to a direction perpendicular to the sheet conveyance direction, the misalignment of a sheet in the width direction can be corrected based on the reference surface.

If the force of pressing the reference surface by a sheet (the force of drawing a sheet by the pairs of skew feeding correcting rollers) is excessively large when a side of the sheet is set to abut against the reference member in the sheet aligning apparatus, the sheet bends and a sheet jam or deterioration of correction accuracy occurs.

In order to solve the above problem, there is proposed an apparatus with existing pairs of skew feeding correcting rollers that adjusts the force of pressing the reference surface by a sheet by changing the nip pressure of a pair of skew feeding correcting rollers according to the thickness of a sheet, in correcting skew feeding with the existing pairs of rollers (see U.S. Pat. No. 5,253,862). This apparatus can correct skew feeding without bending a sheet when drawing a side edge of the sheet to the reference surface.

The existing method of correcting skew feeding of a sheet according to the side registration reference by adjusting the nip pressure of the skew feeding is disadvantageous in that there is difficulty in setting the position of a sheet in a stable state in correcting skew feeding, although the force of pressing the abutting reference member can be adjusted. In particular, when a sheet to be conveyed is such a paper as a coated paper with a basis weight of smaller than 80 gsm, which is super thin and has a small rigidity or when a sheet has a reduced rigidity under high-temperature and high-humidity environments, the following problems may occur.

The number of pairs of skew feeding correcting rollers provided is two or more, and they are arranged in the sheet conveyance direction. When an upstream pair of the skew feeding correcting rollers that first conveys a sheet starts conveying a sheet, the sheet is rotated and is caused to abut against the reference surface of the abutting reference member at a side edge of the sheet with a bent occurring at the side edge. Although a sheet with a large rigidity is not easily bent, a sheet with a small rigidity is bent and passed to a next pair of skew feeding correcting rollers. Accordingly, the difference in the degree of bending generated in the sheet conveyance direction can result into insufficient correction of skew feeding, or the bending can lead to buckling (breaking) and a paper jam may be caused.

SUMMARY OF THE INVENTION

The present invention has been made in view of the above problems, and provides a sheet conveying apparatus and an image forming apparatus which have a skew feeding correcting mechanism capable of reliably correcting skew feeding of a sheet even with a small rigidity.

A sheet conveying apparatus according to the present invention includes: a first rotary portion which nips and conveys a sheet; a reference surface which is provided along a direction in which the sheet is conveyed; a plurality of second rotary portions arranged along the sheet conveyance direction, each of the portions nipping and obliquely conveying the sheet conveyed by the first rotary portion so as to contact the side edge of the sheet to the reference surface; a first switching portion which switches the first rotary portion between a state of nipping the sheet and a state of nip releasing the sheet; a second switching portion which switches and the second rotary portions between a state of nipping the sheet and a state of nip releasing the sheet; and a controller which controls the first switching unit and the second switching unit so that the nip of the sheet by the first rotary portion is released after the conveyed sheet is nipped by at least two of the second rotary portions.

Further features of the present invention will become apparent from the following description of exemplary embodiments with reference to the attached drawings.

DESCRIPTION OF THE EMBODIMENTS

First Embodiment

A sheet conveying apparatus and an image forming apparatus provided with the sheet conveying apparatus according to an embodiment of the present invention will be hereinafter described in detail with reference to accompanying drawings.

<Image forming apparatus>

First, descriptions will be made of the entire configuration of an image forming apparatus according to the embodiment. Color image forming apparatuses are roughly grouped into a rotary system and a tandem system according to configurations, the rotary system having a configuration in which a plurality of image forming portions is arranged in a row and a tandem system having a configuration in which a plurality of image forming portions is arranged in a cylindrical pattern. Further, they are also grouped into a direct transfer system and an intermediate transfer system according to transfer system, the direct transfer system being a system of directly transferring a toner image onto a sheet material from a photoreceptor and the intermediate transfer system being a system of transferring a toner image on a sheet material after transferring the toner image on an intermediate transfer member.

Figure 1:
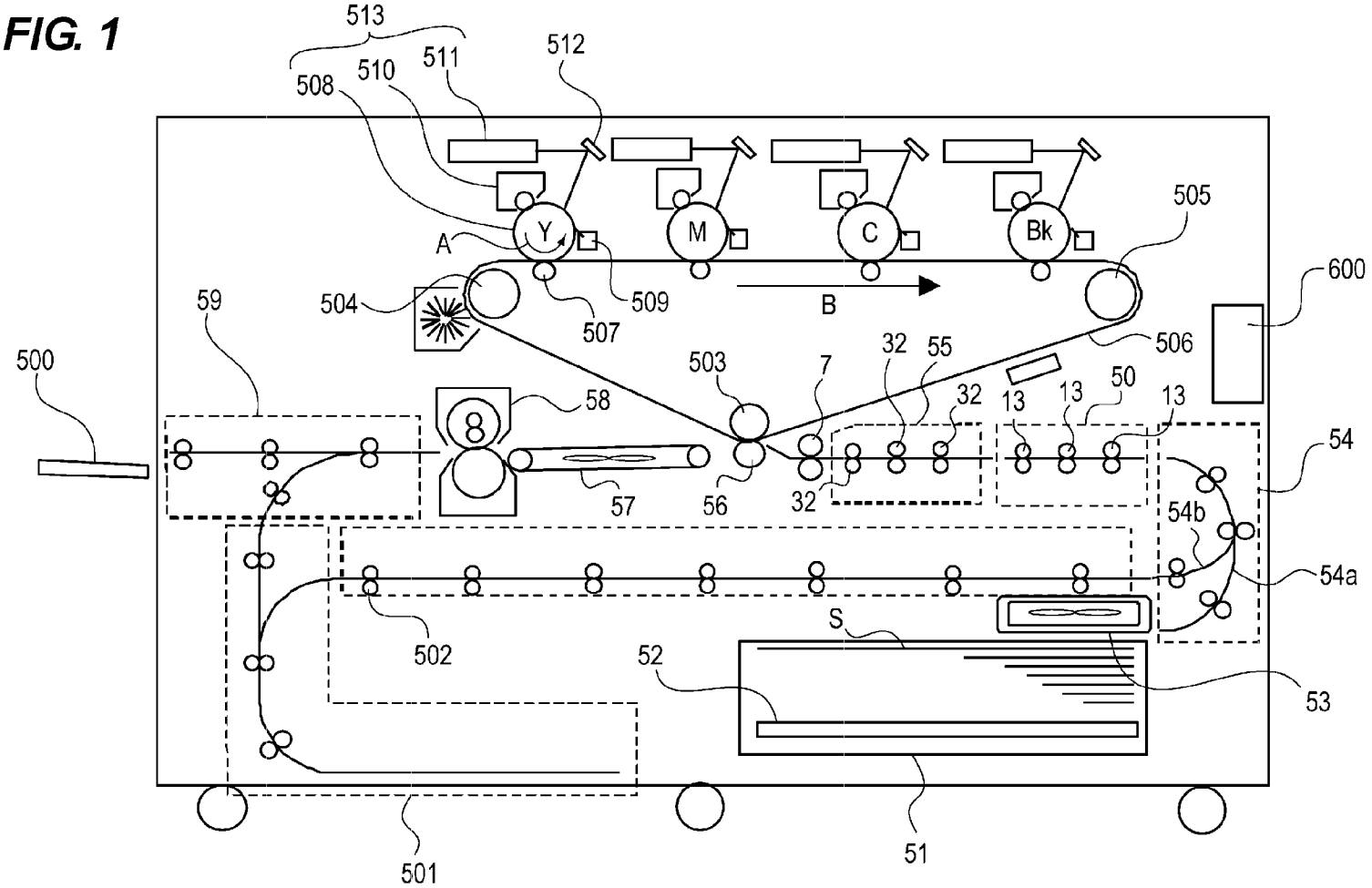
FIG. 1 is a diagram illustrating an image forming apparatus provided with a sheet conveying apparatus.

FIG. 1 illustrates an image forming apparatus according to an embodiment of the present invention that uses the intermediate transfer tandem system, in which image forming portions of four colors are arranged in a row on an intermediate transfer belt. The intermediate transfer system is applicable to different kinds of transfer materials including a super-thick paper and a coated paper, because the intermediate transfer system does not require a transfer material to be held on a transfer drum or a transfer belt, unlike the direct transfer system. Moreover, the intermediate transfer system is suitable for realizing high productivity since it can perform parallel processing by a plurality of image forming portions and transfer of full-colored images all at once. The configuration and operation of an image processor according to the embodiment will be described.

A sheet S is contained to be placed on a lift-up apparatus 52 of a sheet feeding apparatus 51, and is fed by a sheet feeding portion 53 when an image is formed by the image forming apparatus. The sheet feeding portion 53 may employ one of methods using the friction and division by a feeding roller, for example, and using division and adsorption by air, and it adopts a feeding method using air in the image forming apparatus of the embodiment.

The sheet S fed by the sheet feeding portion 53 passes through a conveyance path 54*a* of a conveying unit 54 and reaches a skew feeding correcting portion 55. Further, the skew feeding correcting portion 55 conducts skew feeding correction and timing correction, the sheet is sent to a secondary transfer portion. The secondary transfer portion is a nip part having a secondary transfer inner roller 503 and a secondary transfer outer roller 56 practically facing each other, and transfers a toner image onto the sheet S. Specifically, the secondary transfer portion transfers an unfixed image onto the sheet S by applying a predetermined pressure and electrostatic load bias.

Subsequently, descriptions will be made of a process of forming an image, the image being sent to the secondary transfer portion concurrently with the conveyance of the sheet S to the secondary transfer portion.

An image forming apparatus 513 mainly includes a photoreceptor 508, an exposure apparatus 511, a developing apparatus 510, a primary transfer unit 507, and a photoreceptor cleaner 509. The photoreceptor 508 is uniformly charged, in advance, on a surface thereof by a charging portion, and rotates in a direction indicated by an arrow A in FIG. 1. The exposure apparatus 511 emits a light to the photoreceptor 508 based on a signal of received image information, and the light adequately passes through a diffraction member 512, for example, so that an electrostatic latent image is formed. The developing apparatus 510 develops the latent image formed on the photoreceptor 508 with toner, and a toner image is formed on the photoreceptor. Thereafter, the primary transfer unit 507 applies a predetermined pressure and transfer bias and the toner image is transferred onto the intermediate transfer belt 506. Subsequently, a small amount of toner which is left on the photoreceptor 508 is collected by the photoreceptor cleaner 509 and will be used for the next image formation. The embodiment uses four image forming apparatuses 513 for yellow (Y), magenta (M), cyan (C), and black (Bk) colors. The colors are not limited to the four colors above and the order of colors is not limited to the above.

The intermediate transfer belt 506 is stretched by such rollers as the driving roller 504, a tension roller 505, and the secondary transfer inner roller 503, and is driven to convey a sheet into a direction indicated by an arrow B in FIG. 1. Accordingly, the image formation processes for obtaining images of the colors Y, M, C, and Bk carried out in parallel by the image forming apparatuses 513 are conducted concurrently with overlapping with an upstream toner image primarily transferred on the intermediate transfer belt. Thus, a full-colored toner image is formed on the intermediate transfer belt 506 and is conveyed to the secondary transfer portion.

In that way, a full-colored toner mage is secondary-transferred onto the sheet S in the secondary transfer portion through the sheet-S conveyance process and the image formation process. The sheet S is thereafter conveyed to a fixing apparatus 58 by a pre-fixing conveying portion 57. The fixing apparatus 58 makes the toner fused and fixed on the sheet S with a predetermined pressure by rollers, belts, etc. practically facing each other and with an effect of heating by a heat source such as a heater. The sheet S with the image fixed thereon is discharged to a discharge tray 500 by a branch conveying apparatus 59, or is conveyed to a reverse conveying apparatus 501 if the sheet S needs an image fixed on both surfaces.

When an image is to be formed on both surfaces of the sheet S, the sheet S conveyed to the reverse conveying apparatus 501 is switched back so that the front and back edges of the sheet S are switched, and is conveyed to a double surface conveying apparatus 502. Next, the sheet S joins a sheet for a subsequent job conveyed from the sheet feeding apparatus 51 at a re-feeding path 54*b* of the conveying unit 54, and is sent to the secondary transfer portion. The image formation process for the front surface is applied to the back surface.

In the sheet conveyance paths of the conveying unit 54, the branch conveying apparatus 59, the reverse conveying apparatus 501, and the double surface conveying apparatus 502, there are a large number of conveying roller apparatuses. Each conveying roller apparatus conveys a sheet while nipping the sheet between a driving roller and a driven roller. Further, in each conveying roller apparatus, a driven roller is provided with a biasing member such as a spring so that a pressure of nipping a sheet between the rollers is set.

<Sheet Conveying Apparatus>

Subsequently, descriptions will be made of the sheet conveying apparatus used in the image forming apparatus. FIGS. 2A to 2D illustrate top views of a sheet aligning apparatus having a conveying portion 50, a skew feeding correcting portion 55, and a registration roller 7.

The sheet conveying apparatus according to the embodiment has the skew feeding correcting portion 55 for correcting a misalignment of a sheet while the sheet is being conveyed. Among the methods employable by the skew feeding correcting portion 55 is one according to a side registration reference, which corrects a misalignment of a sheet with respect to a side edge of the sheet when the sheet is being conveyed. The present embodiment is a case where the skew feeding correcting portion 55 is arranged at the upper position of the secondary transfer portion. Other than at the upper position of the secondary transfer portion, the skew feeding correcting portion 55 applying the side registration reference may be used in a sheet post-processing apparatus for performing post processing on a fixed sheet.

The sheet conveying apparatus includes the conveying portion 50 which nips and conveys a sheet with a pair of conveying rollers 13, and the skew feeding correcting portion 55 having a pair of skew feeding correcting rollers 32 for drawing the sheet conveyed by the conveying portion 50 to a reference member to align the sheet.

The conveying portion 50 includes a plurality of pairs of conveying rollers 13, which are first rotary portions and are arranged in the sheet conveyance direction. Each pair of conveying rollers 13 is formed of a driving roller 13*a* and a driven roller 13*b*, the driving roller 13*a* being driven and rotated by driving force of a motor (drive source) and the driven roller 13*b* being pressed with and rotated by the driving roller 13*a*. The number of pairs of conveying rollers 13 provided is at least two, and they are arranged in the sheet conveyance direction. Further, the driven roller 13*b* is formed to freely press against or become separated from the driving roller 13*a*. With that configuration, nip and nip release of a sheet by the pair of conveying rollers 13 can be switched.

The skew feeding correcting portion 55 mainly includes a skew feeding portion 30 which draws a sheet to the reference member and a fixed guide 33. The skew feeding portion 30 can move into a width direction of the sheet S perpendicular to the sheet S according to the size of the sheet S. The skew feeding portion 30 includes an abutting reference member 31 which determines the position of a side edge of a sheet to be conveyed along the conveyance direction, and a plurality of pairs of skew feeding correcting rollers 32 (32-1, 32-2, and 32-3) as the second rotary portions.

Although the embodiment employs three pairs of skew feeding correcting rollers 32-1, 32-2, and 32-3 arranged from the upper to the lower side of the sheet conveyance direction, the number of the pairs of skew feeding correcting rollers 32 may be four or more.

Each pair of skew feeding correcting rollers 32 is formed of a driving roller 32*a* and a driven roller 32*b*, the driving roller 32*a* being driven and rotated by a motor and the driven roller 32*b* being pressed with and rotated by the driving roller 32*a*. The number of pairs of skew feeding correcting rollers provided is at least two, and they are arranged in the sheet conveyance direction. The driven roller 32*b* is formed to freely press against or become separated from the driving roller 32*a*. With that configuration, the nip and nip release of the sheet by the pairs of skew feeding correcting rollers can be switched.

It is to be noted that in the embodiment, the skew feeding correcting portion 55 has a registration roller 7 for conveying a sheet to the secondary rotary portion.

Figure 2A:
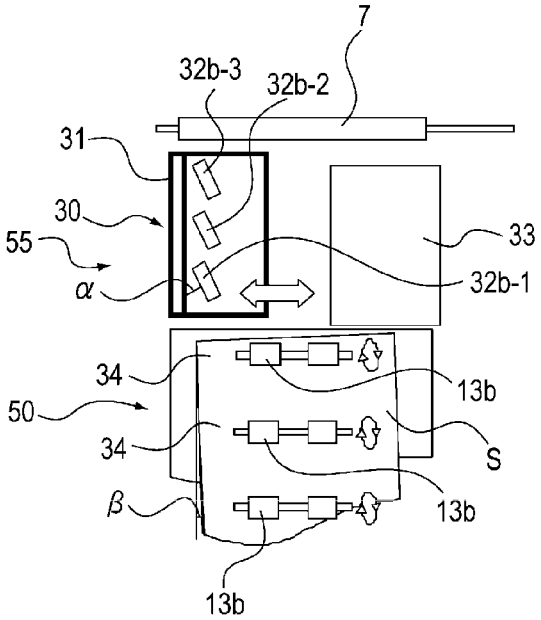
FIGS. 2A to 2D are schematic top views of the sheet conveying apparatus.
Figure 6A:
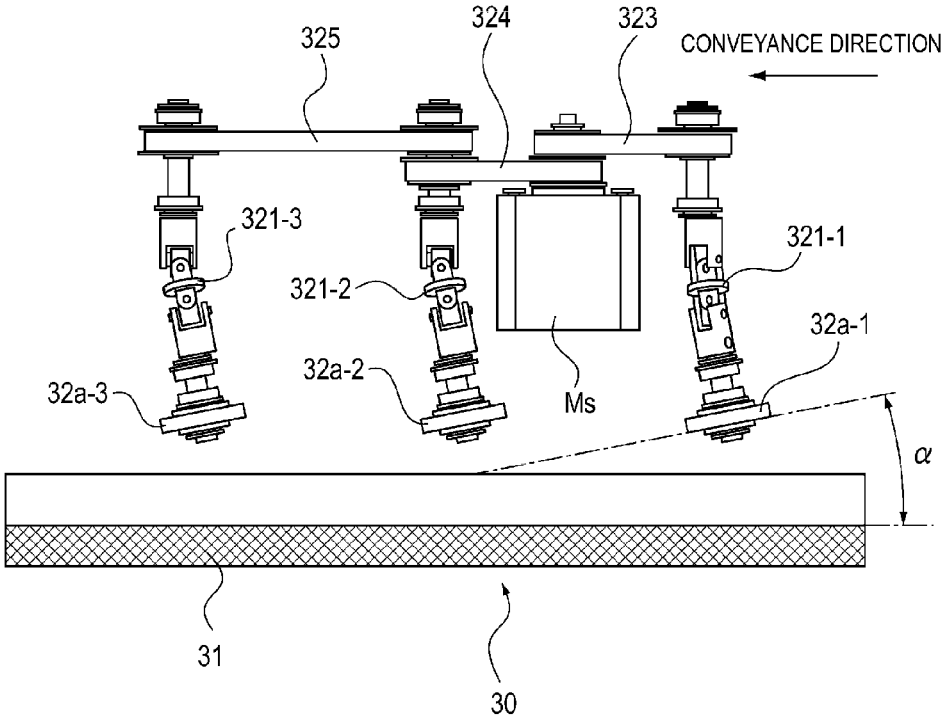
FIGS. 6A and 6B are a drive top view of a skew feeding portion and an explanation diagram of a reference member, respectively.
Figure 6B:
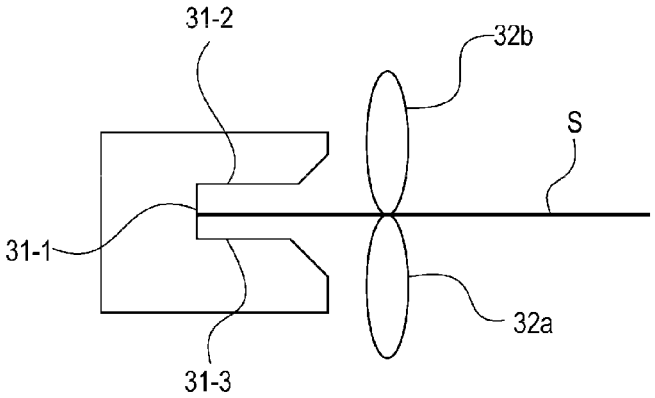

As FIGS. 2A, 6A, and 6B illustrate, the abutting reference member 31 has a reference surface 31-1 parallel to the direction in which the sheet S is conveyed. The direction in which the pairs of skew feeding correcting rollers 32 convey a sheet is inclined at a predetermined angle $\alpha$ to the reference surface 31-1 of the abutting reference member 31. Accordingly, a side edge of the sheet S conveyed by the pairs of skew feeding correcting rollers 32 is caused to abut against the reference surface 31-1.

Figure 2B:
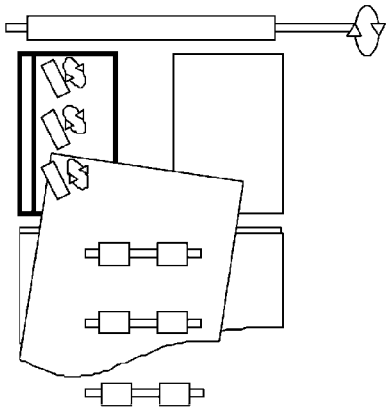
Figure 2C:
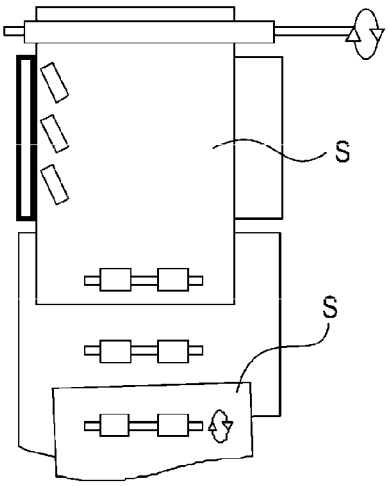
Figure 2D:
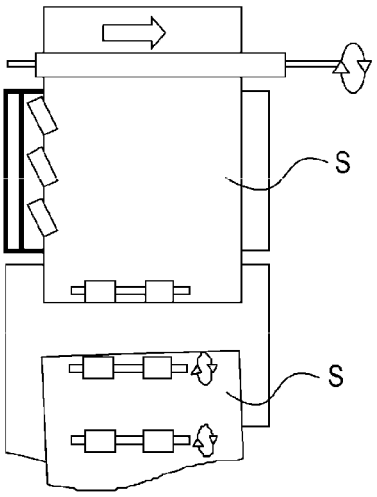

Assume that the sheet S enters the skew feeding correcting portion 55 while being skew-fed with a side edge being at an angle $\beta$ to the reference surface 31-1, as illustrated in FIG. 2A. The sheet S conveyed to the pairs of skew feeding correcting rollers 32 by the pair of conveying rollers 13 is obliquely conveyed to the abutting reference member 31, as illustrated in FIG. 2B. A side edge of the sheet S is made to abut against the reference surface 31-1 of the abutting reference member 31 by the skew feeding correcting portion 55, and is aligned to become parallel to the sheet conveyance direction, as illustrated in FIG. 2C. Subsequently, when the sheet S is nipped by the registration roller 7, the pairs of skew feeding correcting rollers 32 release the nip of the sheet S, as illustrated in FIG. 2D. Thereafter, the registration roller 7 slides into the width direction of the sheet perpendicular to the sheet conveyance direction while nipping the top edge of the sheet S1, in order to match the position of an image to the position of the sheet.

(Configuration of Nip and Nip Release by the Conveying Portion)

Next, the configuration of a first switching unit will be described, which switches the pair of conveying rollers 13 between a state of nipping a sheet and a state of nip releasing a sheet.

Figure 3A:
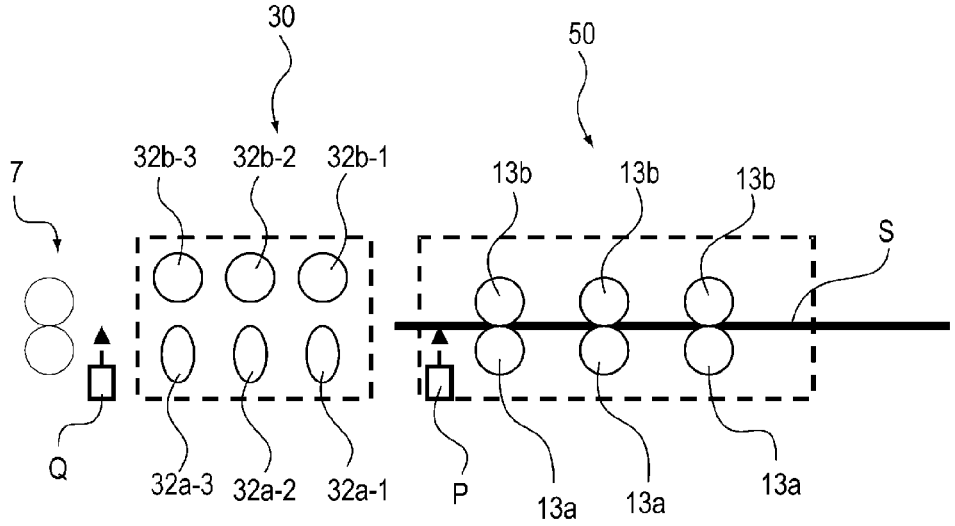
FIGS. 3A and 3B are schematic cross-sectional views of the sheet conveying apparatus.
Figure 3B:
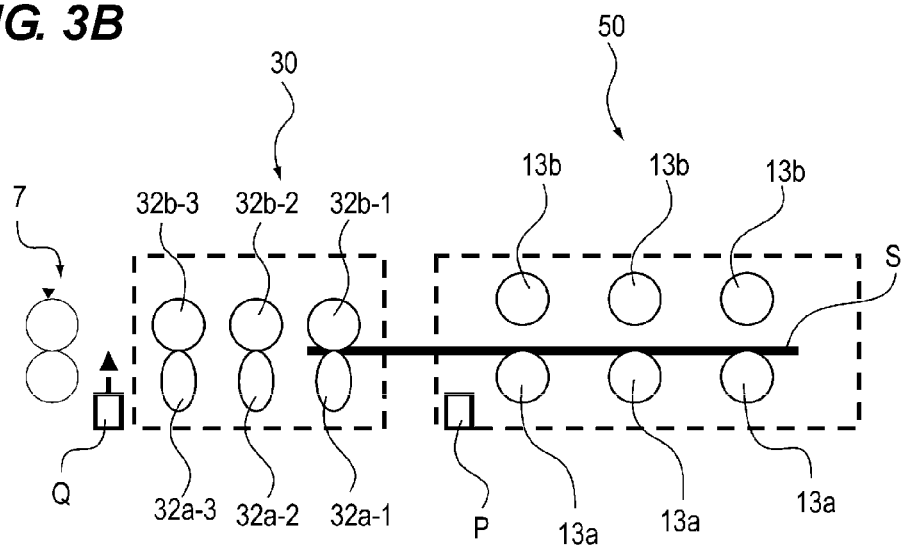

FIGS. 3A and 3B are cross-sectional views illustrating the nip releasing actions of the pair of conveying rollers 13 and the pairs of skew feeding correcting rollers 32. The pair of conveying rollers 13 is formed of a driving roller 13*a* of rubber and a driven roller 13*b* of resin. Between the conveying portion 50 and the skew feeding portion 30 (upper side of the conveyance direction of the skew feeding portion 30), a first sheet sensor P as the first detecting portion is provided. Further, a second sheet sensor Q as the second detecting portion is provided immediately in front of the registration roller 7. The first sheet sensor P is for detecting the passage of the top edge of a sheet through the conveying portion 50, and the second sheet sensor Q is for detecting the conveyance of the top edge of a sheet to immediately in front of the registration roller 7. The first and second sheet sensors P and Q are each an optical sensor having a light emitting portion and a light receiving portion. When the sheet S passes, the light receiving portion detects reflected light from the sheet S and outputs a detection signal. Based on detection signals from the first and second sheet sensors P and Q, a controller 600 detects the timing of passage of the sheet S. The controller 600 will be described later.

When the first sheet sensor P detects the top edge of a sheet, the controller 600 stops a conveying motor Mp which drives the driving roller 13*a* of the pair of conveying rollers 13, based on a detection signal from the first sheet sensor P. The stop of driving of the pair of conveying rollers 13 can adjust variations in the sheet conveyance time. The sheet S is thereafter conveyed to the skew feeding portion 30, the driven roller 13*b* is released, and the skew feeding correction is started.

Figure 4A:
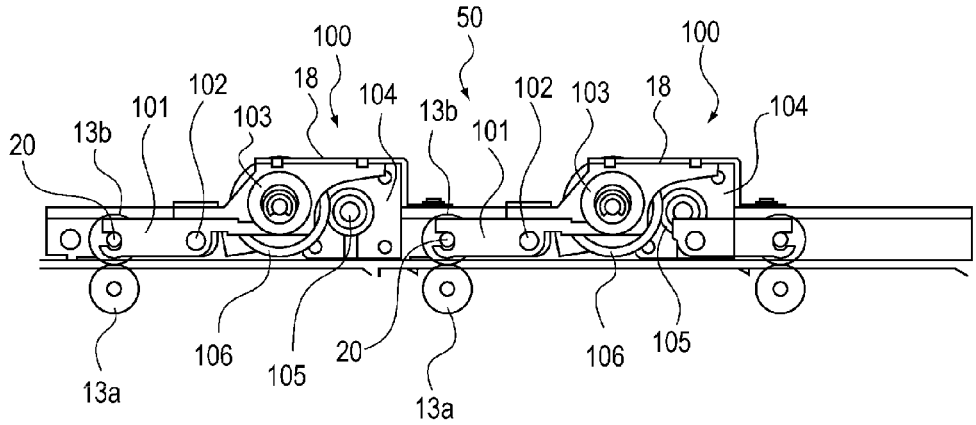
FIGS. 4A and 4B are cross-sectional views of a conveying portion with a nip pressure applied and removed, respectively.
Figure 4B:
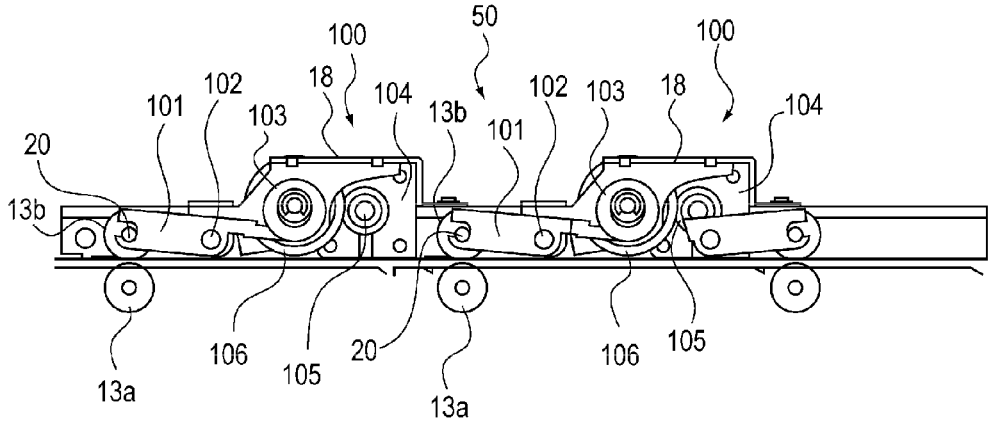

The nip releasing mechanism of the pair of conveying rollers 13 is configured as FIGS. 4A and 4B illustrate. FIG. 4A is a cross-sectional diagram illustrating a state of the pair of conveying rollers 13 when a nip pressure is applied. The driven roller 13*b* is supported by an arm member 101 also supporting a driven shaft 20, and the arm member 101 is arranged to a stray member 18 via a rocking shaft 102 so as to freely rock. The nip is released in such a manner that an eccentric roller 103 is rotated to press an edge part of the arm member 101 and the nip is rotated in the release direction around the rocking shaft 102.

FIG. 4B is a cross-sectional diagram illustrating a state of the pair of conveying rollers 13 when the nip is released. The conveying portion 50 has a pressing unit for pressing the arm member 101. Specifically, the arm member 101 is rocked with the rocking shaft 102 as the center, in such a manner that the conveying nip motor 104 as a stepping motor is rotated and the eccentric roller 103 is rotated by a gear row 105 and 106. In that way, the nip by the driven roller 13*b* is released in response to the timing of release. The controller 600 drives the conveying nip motor 104 according to the time of detection by the first sheet sensor P so that the time of releasing the nip can be varied.

Figure 5:
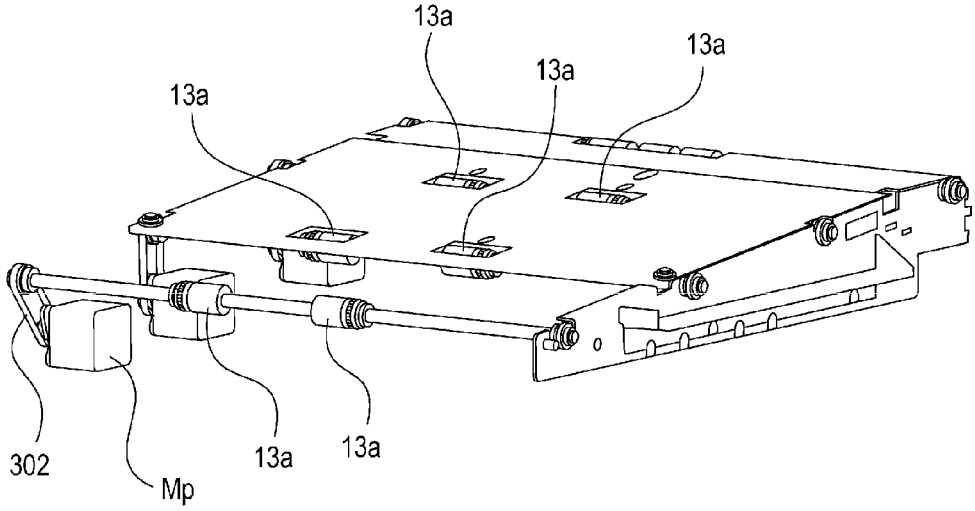
FIG. 5 is a perspective view of a driving portion of the conveying portion.

FIG. 5 is a perspective view of a driving portion of the conveying portion 50. The driving roller 13*a* receives drive force from the conveying motor Mp via a pulley and a belt 302 at a shaft integrally formed with a rubber roller, the conveying motor Mp being a stepping motor. The timings of starting and stopping the rotation and the number of rotations (rate of conveyance) are controlled by the controller 600 based on detection signals from the first sheet sensor P.

(Configuration of Nip and Nip Release by the Skew Feeding Portion)

Next, the configuration of a second switching unit will be described, which switches the pairs of skew feeding correcting rollers 32 between a state of nipping a sheet and a state of nip releasing a sheet. FIG. 6A is a top view of a driving portion of the skew feeding portion 30. The pairs of skew feeding correcting rollers 32 are arranged to be at the angle $\alpha$ to the abutting reference member 31, as described above. Each driving roller 32*a* (32*a*-1, 32*a*-2, and 32*a*-3) receives drive force from the skew feeding motor Ms via a universal joint 321 (321-1, 321-2, and 321-3), a pulley, and conveyance belts 323, 324, and 325. The skew feeding motor Ms for driving the pairs of skew feeding correcting rollers 32 is a stepping motor. The timings of starting and stopping the rotation and the number of rotations (rate of conveyance) are controlled by the controller 600.

FIG. 6B is a cross-sectional view of the abutting reference member 31 viewed from the sheet conveyance direction in FIG. 6A. The abutting reference member 31 has a reference surface 31-1 against which a side edge of the sheet S abuts, and an upper guide 31-2 and a lower guide 31-3 defining the upper and lower directions of the sheet S, respectively.

Figure 7A:
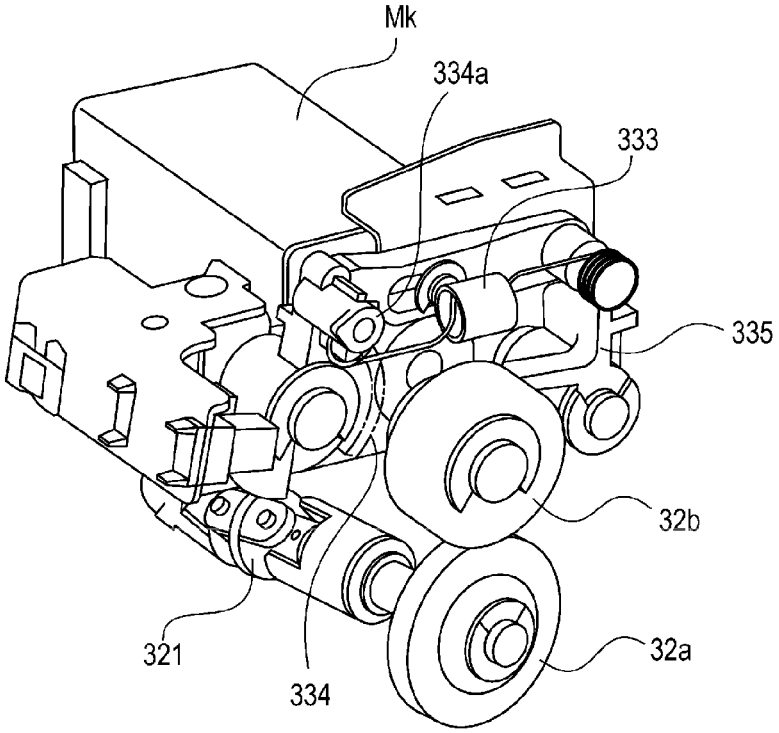
FIGS. 7A and 7B are perspective and side views of a pressing mechanism of the skew feeding portion, respectively.
Figure 7B:
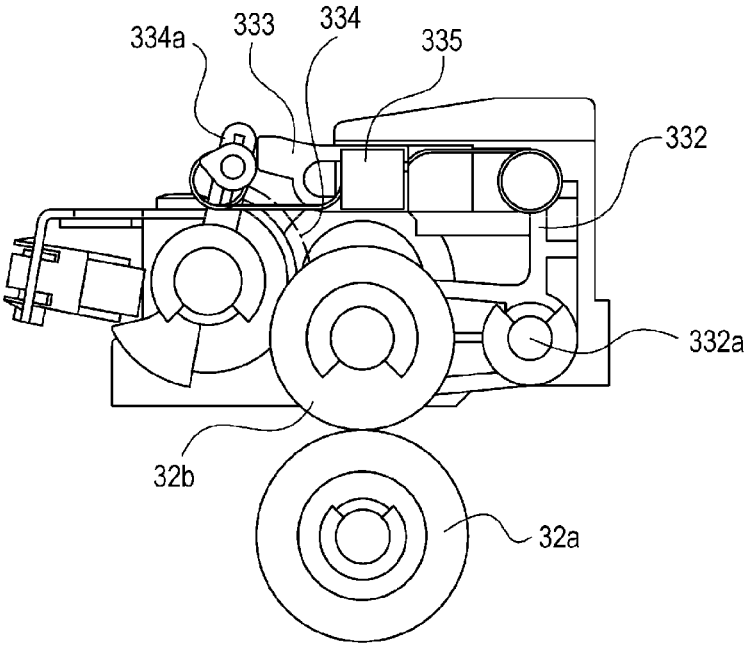

FIGS. 7A and 7B are perspective and side views of a pressing/separation mechanism of the driving roller 32*a* and the driven roller 32*b* facing each other of a pair of skew feeding correcting roller, respectively.

As FIGS. 7A and 7B illustrates, the driven roller 32*b* has a tension spring 335 between an L-shaped link 332 rotatably supporting the driven roller 32*b* and an arm portion 334*a* provided to the pressure gear 334, and the skew feeding nip motor Mk allows the pressure gear 334 to rotate. The nip pressure (nip pressure of the sheet S) is set according to the rotation angle of the skew feeding nip motor Mk.

Figure 8A:
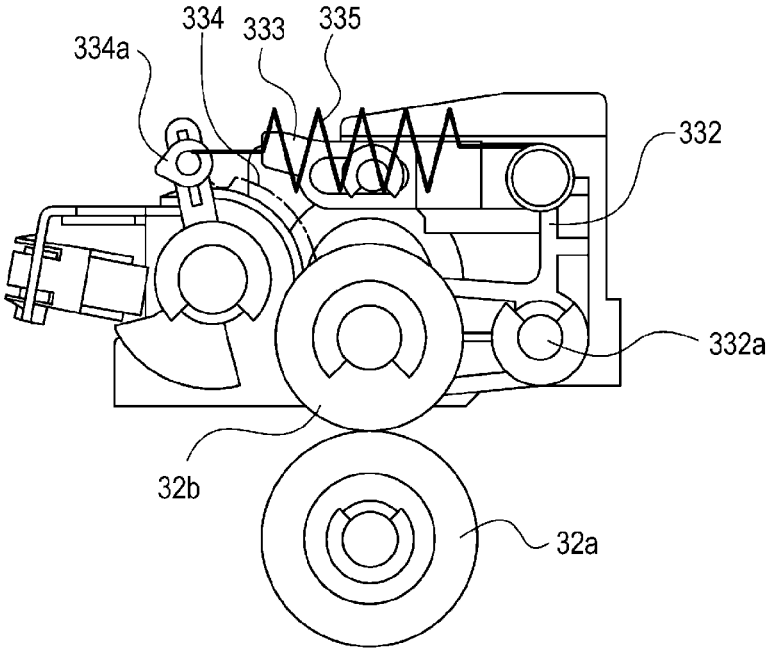
FIGS. 8A and 8B are side views of the skew feeding portion with a nip pressure applied and removed, respectively.

FIG. 8A illustrates a state of a pair of skew feeding correcting rollers 32 when a nip pressure is applied. The pressure gear 334 stops after having rotated in the counter-clockwise direction in FIG. 8A and the tension spring 335 is pulled so that the link 332 is rotated around the shaft 332*a*, whereby the nip of the pair of skew feeding correcting rollers 32 is pressed.

Figure 8B:
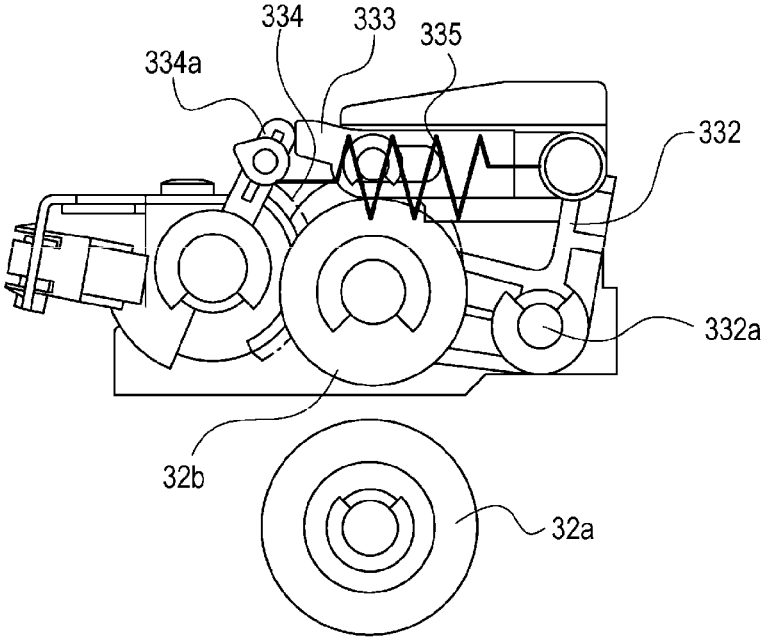

FIG. 8B illustrates a state of a pair of skew feeding correcting rollers 32 when a nip pressure is removed. The pressure gear 334 stops after having rotated in the clockwise direction in FIG. 8B, and the arm portion 334*a* pressurizes the link 333, whereby the link 332 supporting the driven roller 32*b* is rotated around the shaft 332*a* in the clockwise direction. This action causes the driven roller 32*b* to be separated from the driving roller 32*a*, resulting into release of the nip. Since the skew feeding nip motor Mk is a stepping motor, setting a step angle makes it possible to vary the setting of a nip pressing amount for the pairs of skew feeding correcting rollers 32.

The driven rollers 32*b* of a plurality of pairs of skew feeding correcting rollers 32 (3 pairs in the embodiment, a first pair of rollers 32*a*-1, 32*b*-1, a second pair of rollers 32*a*-2, 32*b*-2 and a third pair or rollers 32*a*-3, 32*b*-3) individually have the pressing/separation mechanism for the pairs. Accordingly, the nip pressures of the driven rollers 32*b* (32*b*-1, 32*b*-2, and 32*b*-3) can be independently set. Further, the driven rollers 32*b* can be separated from their corresponding driving rollers 32*a*.

<Control Block Diagram>

Figure 9:
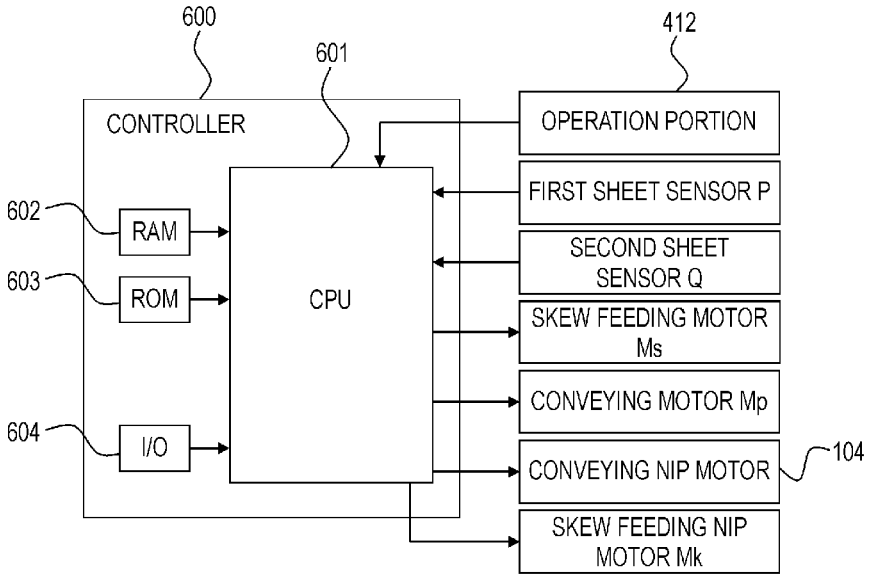
FIG. 9 is a control block diagram.

FIG. 9 is a block diagram illustrating the components controlling the nip pressing and nip releasing for the pairs of skew feeding correcting rollers 32 of the skew feeding correcting portion 55.

The controller 600 includes a CPU 601, program storage ROM 603, data temporary-storage RAM 602, and a communication I/O 604. A user confirms the paper size, the basis weight (gsm), and the number of sheet passing, by inputting, at the operation portion 412, information on the sheet S to be used.

The controller 600 controls the skew feeding nip motor Mk based on detection signals from the first sheet sensor P and the second sheet sensor Q, whereby the nip pressing and nip releasing for each pair of skew feeding correcting roller 32 are controlled.

Further, the controller 600 controls the conveying motor Mp, the conveying nip motor 104, the drive of the driving roller 13*a* of the conveying portion 50, and the nip pressing/releasing for the driven roller 13*b*.

Likewise, the controller 600 controls the skew feeding motor Ms, the skew feeding nip motor Mk, the drive of the driving roller 32*a* of the skew feeding correcting portion 55, and the nip pressing/releasing for the driven roller 32*b*. Since the driven rollers 32*b* of the skew feeding correcting portion 55 individually have the skew feeding nip motor Mk, it is possible to separately control the nip pressing forces (skew feeding pressures), nip pressing timings, and nip releasing timings for the driven rollers 32*b*-1, 32*b*-2, and 32*b*-3.

<Timing of Nip of the Sheet>

Next, descriptions will be made of the timing of nip of the sheet by the pairs of skew feeding correcting rollers 32 of the skew feeding correcting portion 55 according to the embodiment. A method for correcting skew feeding of a sheet according to the embodiment will be described after a method using the side registration reference according to a comparative example is described with reference to FIGS. 10A and 10B.

Figure 10A:
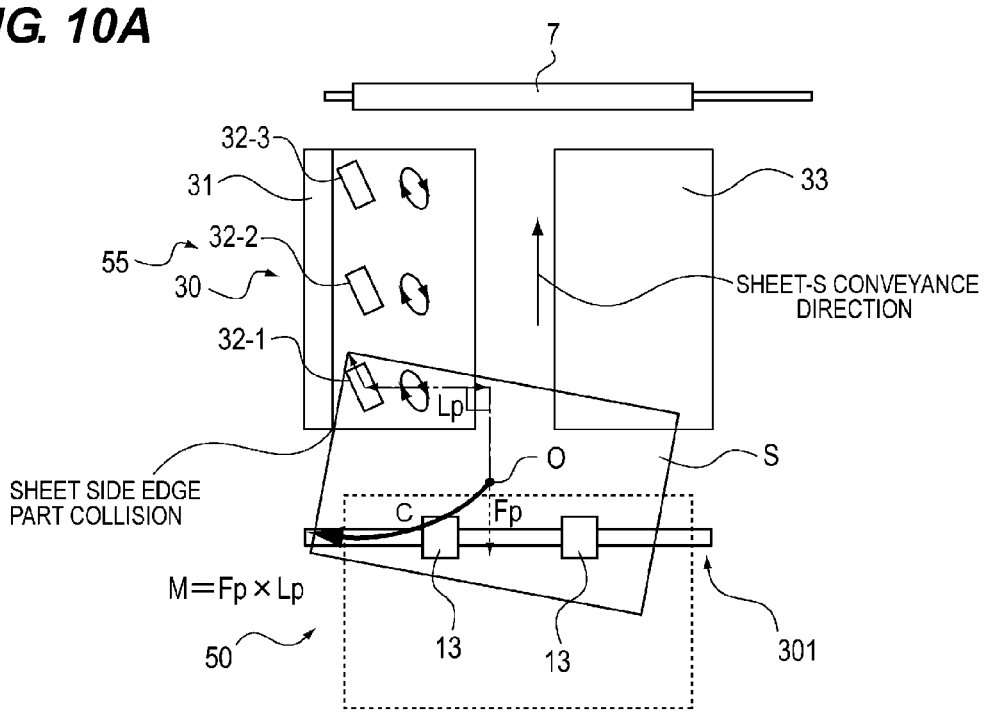
FIGS. 10A and 10B are sheet behavior diagrams at the time of aligning a sheet.
Figure 10B:
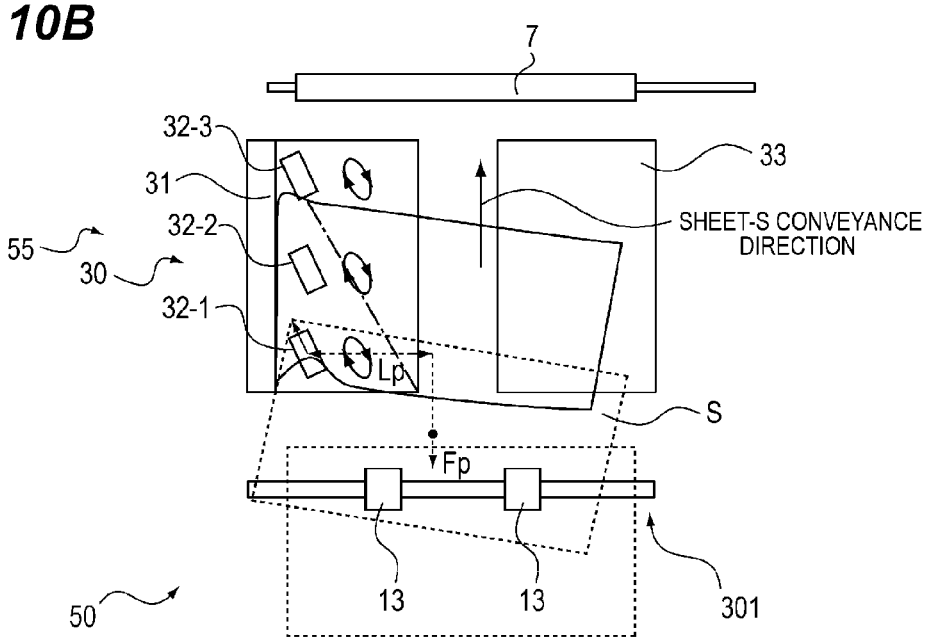

FIGS. 10A and 10B illustrate the skew feeding correcting method for describing the comparative example. In the comparative example, as illustrated in FIG. 10A, the nip of the sheet by the pair of conveying rollers 13 of the conveying portion 50 is released when the top edge of the sheet S conveyed by the conveying portion 50 is nipped by the uppermost pair of skew feeding correcting rollers 32-1 of a plurality of pairs of skew feeding correcting rollers 32.

When the nip of the sheet by the pair of conveying rollers 13 is released, the sheet S receives force Fp into a direction opposite to the conveyance direction due to frictional force generated by friction between the sheet S and a fixed guide 33, for example. If the center of gravity of the sheet S is denoted by O and the distance between the center of gravity and the pair of skew feeding correcting rollers 32-1 in the width direction of the sheet is denoted by Lp, the sheet S receives a moment M expressed by Fp×Lp. With the moment M applied, the sheet S starts rotating in the direction indicated by an arrow C around the pair of skew feeding correcting rollers 32-1, and collides against an entry part of the abutting reference member 31 at a side edge of the sheet S, which causes bending of the sheet S at the side edge.

If the sheet S is small in thickness and rigidity, it is conveyed to the lower direction with the side edge bent, and skew feeding is caused in some cases, as FIG. 10B illustrates. In particular, if the sheet S is a sheet extremely small in rigidity such as a coated paper with a basis weight of smaller than 80 gsm, the bending can lead to buckling (breaking) and eventually to a paper jam.

Figure 11:
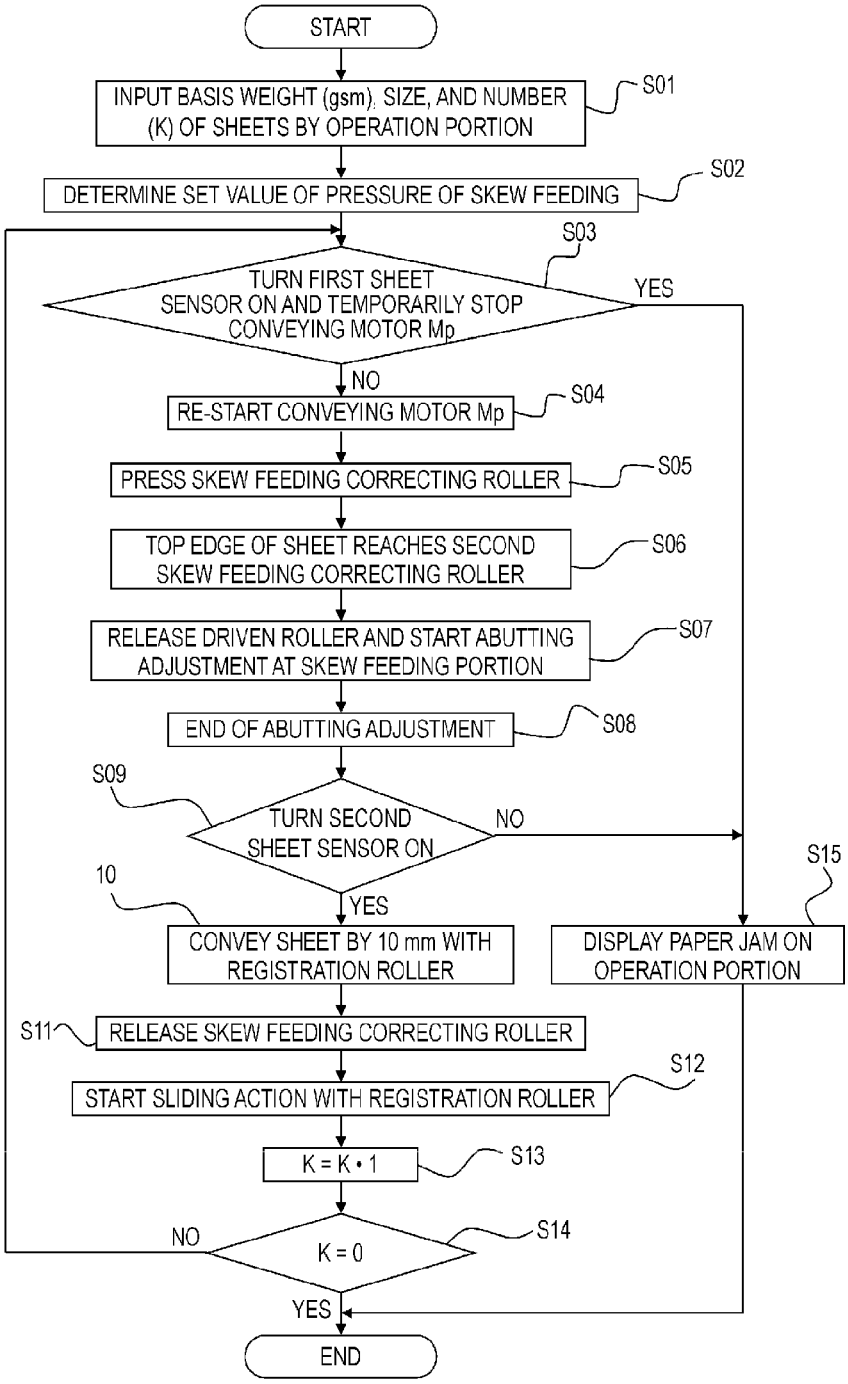
FIG. 11 is a flow chart illustrating the procedures for correcting skew feeding according to a first embodiment.

In order to deal with the problem, the embodiment is so configured that the nip of a sheet by the pair of conveying rollers 13 is released after the top edge of the conveyed sheet reaches at least two of the pairs of skew feeding correcting rollers 32, as the flow chart of FIG. 11 illustrates.

More specifically, the basis weight (gsm), size, and number (K) of sheet passing are input at the operation portion (Step S01) and sheet passing is started. A set value of the nip pressure force (skew feeding pressure) for the pairs of skew feeding correcting rollers 32 is determined based on the basis weight or size of the sheets (Step S02).

When the sheet having been fed reaches the conveying portion 50, it is conveyed to the skew feeding portion 30 while being nipped by the pair of conveying rollers 13. Further, when the first sheet sensor P detects the top edge of the sheet S (ON), the controller 600 stops temporarily the conveying motor Mp based on the detection signal and adjusts the inter-paper time (Step S03). When the first sheet sensor P, on the other hand, does not detect the top edge of the sheet S for a predetermined time, the controller 600 makes the operation portion display a paper jam (delay jam) and the processing ends (S15).

Subsequently, the conveying motor Mp is restarted (Step S04), and the sheet S is conveyed to the skew feeding portion 30. The skew feeding nip motor Mk is driven at a time chosen from the restart of the conveying motor Mp to before the arrival of the top edge of the sheet S to the pairs of the skew feeding correcting rollers 32 so that the respective driven rollers **32*b*-1, 32*b*-2, and 32*b*-3 of the pairs of skew feeding correcting rollers 32-1, 32-2, and 32-3 are pressed. In that way, the nip pressure of the pairs of skew feeding correcting rollers 32 is set at the set value of the skew feeding pressure previously determined (Step S05**). It is to be noted that the driven rollers may be simultaneously pressed or sequentially pressed from the upper to the lower side of the conveyance direction.

Thereafter, the pair of conveying rollers 13 releases the nip of the sheet by releasing the nip (nip release). Since the timing of the nip release is an important feature of the embodiment, it will be described in detail based on the behavior of the sheet with reference to FIGS. 12A and 12B.

The nip release of the sheet by the pair of conveying rollers 13 is conducted after the top edge of the sheet reaches the one of the plurality of pairs of skew feeding correcting rollers 32 arranged which is the second nearest pair of skew feeding correcting rollers 32 from the upstream side. Herein, the time required for the top edge of the sheet to reach the second nearest pair of skew feeding correcting rollers 32 from the upstream side is calculated by a CPU 601 based on the detection of the top edge by the first sheet sensor P and the rate of sheet conveyance by the pair of conveying rollers 13. After the time obtained by the calculation has passed, the conveying nip motor 104 is driven to release the nip by the pair of conveying rollers 13. The nip of the sheet S by the pair of conveying rollers 13 is thus released after the sheet S is nipped by two pairs of skew feeding correcting rollers 32.

The sheet conveyance force of the conveying portion 50 is set to be larger than that of the pairs of skew feeding correcting rollers 32. Hence, if the sheet is nipped by the uppermost pair of skew feeding correcting rollers 32-1, the pair of skew feeding correcting rollers 32-1 is slipping during the nip of the sheet by the pair of conveying rollers 13 and the rotation as described above does not generate.

Figure 12A:
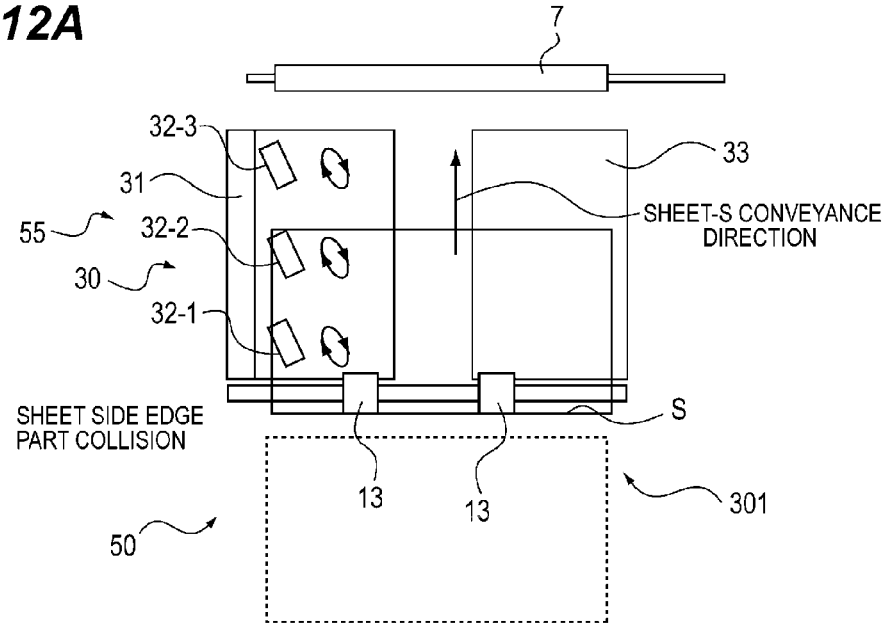
FIGS. 12A and 12B are sheet behavior diagrams at the time of aligning a sheet according to the first embodiment.
Figure 12B:
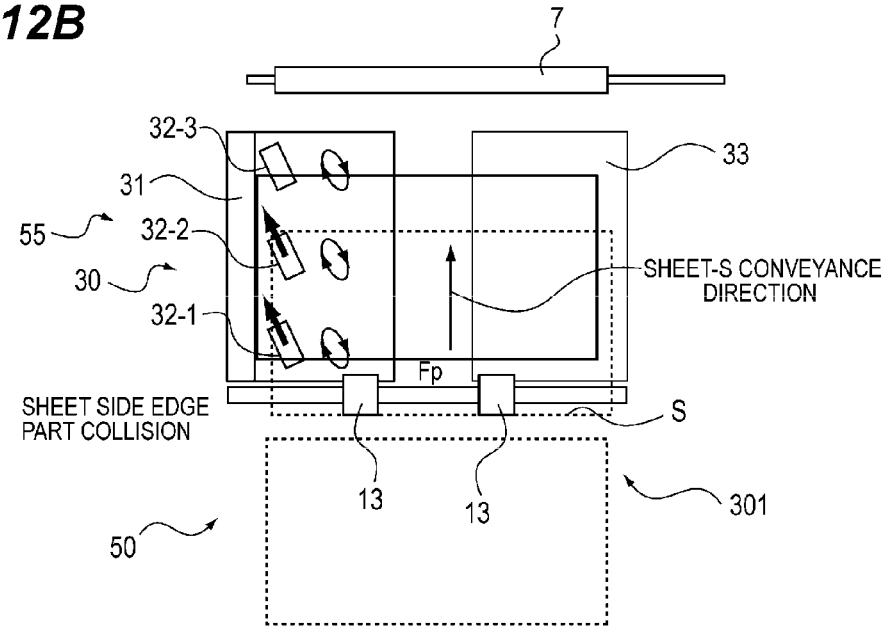

Further, when the sheet is nipped by the second pair of skew feeding correcting rollers 32-2 as illustrated in FIGS. 12A and 12B, the nip of the sheet by the pair of conveying rollers 13 is released, and skew feeding correction is started (Step S07). Since the sheet is nipped by two pairs of skew feeding correcting rollers 32-1 and 32-2, occurrence of rotation can be prevented by cancelling a rate vector generating at the conveyance by one of the pairs of skew feeding correcting rollers with the other pair of skew feeding correcting rollers.

By releasing the nip of the sheet by the pair of conveying rollers 13 as described above, the sheet can be prevented from rotating and occurrence of skew feeding and paper jam can be avoided.

Thereafter, the sheet passes through the skew feeding correcting portion 55 and the skew feeding correction ends (Step S08). After that, if the second sheet sensor Q detects the top edge of the sheet S (Step S09), the controller 600 drives the registration roller 7 based on the detection signal. After the registration roller 7 has conveyed sheets in a predetermined amount (10 mm of sheets in the embodiment) (Step S10), the nips by all the pairs of skew feeding correcting rollers 32 are released (Step S11). Subsequently, the registration roller 7 starts sliding into the axial direction (Step S12).

As the timing of releasing the nip of the sheet by the pairs of skew feeding correcting rollers 32, the release of the nip of the sheet by the pairs of skew feeding correcting rollers 32 is conducted based on the time of detection (ON) of the sheet by the second sheet sensor Q according to a soft-count value of a sum of a time obtained by dividing the distance between the second sheet sensor Q and the registration roller 7 by the sheet conveyance rate of the skew feeding portion 30 and a time necessary for conveying a predetermined amount of sheets (10 mm of sheets in the embodiment) by the registration roller 7.

Further, when the second sheet sensor Q does not detect (ON) the top edge of the sheet S, the controller 600 makes the operation portion display a paper jam (delay jam), and the processing ends (Step S15).

After that, the sheet passing counter determines that K is K−1 (Step S13), and if K is not 0 (Step S14), the nip pressure of the pair of conveying rollers 13 is increased again (not illustrated in the drawing) when the pairs of skew feeding correcting rollers 32 have completed sheet alignment, so that continuous sheet passing is conducted. The processing ends when the sheet passing counter determines that K is 0 (Step S14).

Second Embodiment

Next, descriptions will be made of a method of correcting skew feeding that pays attention to the durability of the pairs of the skew feeding correcting rollers 32 as a second embodiment.

As described above, a sheet in the first embodiment is conveyed to the skew feeding portion 30 after the nip pressure of the pairs of skew feeding correcting rollers 32 is set. However, a sheet may be nipped by a pair of skew feeding correcting rollers 32 after the top edge of the sheet reaches the one of the plurality of pairs of skew feeding correcting rollers 32 which is the second nearest pair of skew feeding correcting rollers 32 from the upstream side, as illustrated in the flow chart of FIG. 13.

Figure 13:
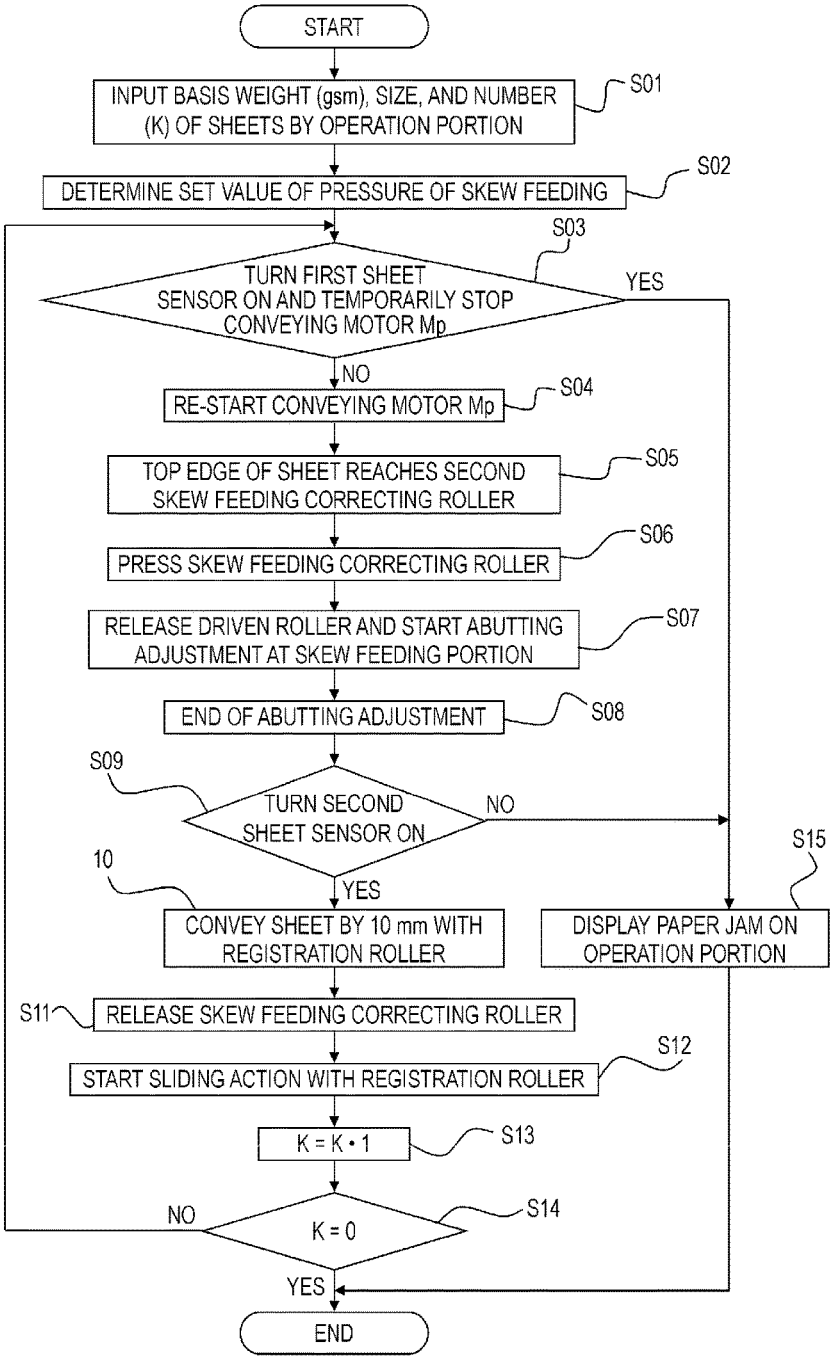
FIG. 13 is a flow chart illustrating the procedures for correcting skew feeding according to a second embodiment.

Note that in the flow chart of FIG. 13, the sequence of Steps S05 and S06 in the flow chart of FIG. 11 according to the first embodiment is switched.

By setting the nip pressure of the sheet by a pair of skew feeding correcting rollers 32 to a predetermined value after the sheet reaches the second nearest pair of skew feeding correcting rollers 32 from the upstream side as in the second embodiment, the time for the pair of skew feeding correcting rollers 32 to slip is reduced and the durability of the driving rubber roller of the pair of skew feeding correcting rollers is improved compared to in the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional application of U.S. application Ser. No. 14/662,362, filed on Mar. 19, 2015, and which claims the benefit of Japanese Patent Application No. 2014-077456, filed Apr. 4, 2014, which are both hereby incorporated by reference in their entireties herein.

What is claimed is:

1. A sheet conveying apparatus comprising:

a first pair of rotary members that nip and convey a sheet in a sheet conveying direction;

a contacting surface which is provided along the sheet conveying direction;

a second pair of rotary members that is disposed next to the first pair of rotary members in the sheet conveying direction, which, obliquely with respect to the sheet conveying direction, conveys the sheet so as to contact the side edge of the sheet to the contacting surface;

a third pair of rotary members that is disposed next to the second pair of rotary members in the sheet conveying direction, which, obliquely with respect to the sheet conveying direction, conveys the sheet so as to contact the side edge of the sheet to the contacting surface;

a first mechanism which switches the first pair of rotary members between a state of nipping the sheet and a state of nip releasing the sheet;

a second mechanism which switches the second pair of rotary members between a state of nipping the sheet and a state of nip releasing the sheet and which switches the third pair of rotary members between a state of nipping the sheet and a state of nip releasing the sheet; and a controller configured to control the second mechanism such that the second pair of rotary members and the third pair of rotary members are changed into the state of nipping the sheet after the sheet reaches to the third pair of rotary members conveyed by the first pair of rotary members under a status that nipping of the sheet by the second pair of rotary members and the third pair of rotary members are released, wherein the controller is further configured to control the first mechanism so as to release nipping of the first pair of rotary members after the sheet is nipped by the second pair of rotary members and the third pair of rotary members, and wherein a conveying force of the first pair of rotary members is larger than a conveying force of the second pair of rotary members so that the second pair of rotary members is slipped against the sheet when the first pair of rotary members, the second pair of rotary members, and the third pair of rotary members nip and convey the sheet.

2. The sheet conveying apparatus according to claim 1, further comprising a detecting portion that is disposed upstream of the second pair of rotary members, wherein the controller controls the first mechanism to release the nipping of the sheet by the first pair of rotary members according to the detection of the sheet by the detecting portion.

3. The sheet conveying apparatus according to claim 1, wherein the second pair of rotary members and the third pair of rotary members are configured with a driving roller and a driven roller, the driving roller being rotated by driving force from a drive source and the driven roller being contacted with the driving roller.

4. The sheet conveying apparatus according to claim 1, wherein a skew feeding of the sheet is corrected by an abutment of the sheet to the contacting surface with the second pair of rotary members and the third pair of rotary members.

5. A image forming apparatus comprising:

the sheet conveying apparatus according to claim 1; and an image forming portion which forms an image on the sheet conveyed by the sheet conveying apparatus.

6. The sheet conveying apparatus according to claim 1, wherein the sheet conveying apparatus comprises a nipping pressure varying portion to vary nipping pressure of the second pair of rotary members, and wherein the nipping pressure varying portion changes the nipping pressure at least according to basis weight or sheet size.

* * * * *